US010450895B2

(12) United States Patent
Amadon

(10) Patent No.: US 10,450,895 B2
(45) Date of Patent: Oct. 22, 2019

(54) STATOR ARRANGEMENT

(71) Applicant: United Technologies Corporation, Farmington, CT (US)

(72) Inventor: Colin G. Amadon, Kennebunk, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 511 days.

(21) Appl. No.: 15/136,130

(22) Filed: Apr. 22, 2016

(65) Prior Publication Data

US 2017/0306796 A1 Oct. 26, 2017

(51) Int. Cl.
*F01D 25/24* (2006.01)
*F01D 9/04* (2006.01)

(52) U.S. Cl.
CPC ..... *F01D 25/24* (2013.01); *F01D 9/041* (2013.01); *F01D 9/042* (2013.01); *F05D 2220/32* (2013.01); *F05D 2240/12* (2013.01); *F05D 2240/14* (2013.01); *F05D 2240/35* (2013.01); *F05D 2260/30* (2013.01)

(58) Field of Classification Search
CPC ..... F01D 25/24; F01D 9/041; F01D 9/042; F05D 2220/32; F05D 2240/12; F05D 2240/14; F05D 2240/35; F05D 2260/30
See application file for complete search history.

(56) References Cited

U.S. PATENT DOCUMENTS 4,249,859 A * 2/1981 Benyi, Jr. ..... F01D 9/04 415/137
4,384,822 A * 5/1983 Schweikl ..... F01D 9/042 415/115
4,687,413 A * 8/1987 Prario ..... F01D 11/08 403/319

(Continued)

FOREIGN PATENT DOCUMENTS

EP 0334794 A2 9/1989
EP 1104836 A2 6/2001

(Continued)

OTHER PUBLICATIONS

European Search Report Issued in EP Application No. 17157103.7; dated Dec. 8, 2017; 13 Pages.

*Primary Examiner* — Jesse S Bogue
(74) *Attorney, Agent, or Firm* — Cantor Colburn LLP

(57) ABSTRACT

A stator includes a plurality of stator vanes and a shroud operably connected to the stator vanes. The shroud includes one or more positioning tabs configured to engage one or more corresponding alignment features of a mating component to radially position the shroud at the mating component, the one or more shroud positioning tabs position the outer shroud to define a radial tip clearance between an outer shroud and an adjacent rotor of the gas turbine engine. A gas turbine engine includes a stator and case assembly in fluid communication with a combustor. The stator and case assembly includes a stator located at a case. The stator has a plurality of stator vanes and a shroud including one or (Continued)

more positioning tabs configured to engage one or more corresponding case alignment features to radially position the shroud at the case.

15 Claims, 5 Drawing Sheets

(56) References Cited

U.S. PATENT DOCUMENTS 5,018,941 A * 5/1991 Heurtel ..... F01D 5/303 416/217
5,224,824 A 7/1993 Eng
5,584,654 A * 12/1996 Schaefer ..... F01D 9/042 415/190
6,575,697 B1 * 6/2003 Arilla ..... F01D 11/005 415/173.1
6,699,011 B2 * 3/2004 Cot ..... F01D 9/04 415/173.1
7,186,079 B2 * 3/2007 Suciu ..... F01D 5/066 415/199.5
7,258,525 B2 * 8/2007 Boeck ..... F01D 9/042 415/191
8,425,184 B2 * 4/2013 Druez ..... F01D 9/042 415/173.1
8,684,674 B2 * 4/2014 Chan ..... F01D 11/001 415/119
9,388,703 B2 * 7/2016 Ikeguchi ..... F04D 29/542
9,683,459 B2 * 6/2017 Aoki ..... F01D 25/246
2003/0035715 A1 * 2/2003 Torrance ..... F01D 11/08 415/58.5
2007/0140857 A1 * 6/2007 Booth ..... F01D 9/042 416/204 R
2009/0246012 A1 * 10/2009 Shapiro ..... F01D 9/042 415/208.1
2014/0037442 A1 2/2014 Tatman et al.
2015/0030443 A1 1/2015 Richardson et al.
2016/0108812 A1 * 4/2016 Rogers ..... F02C 7/06 60/805
2016/0230673 A1 * 8/2016 Milligan ..... F01D 25/246

FOREIGN PATENT DOCUMENTS

EP 1286022 A1 2/2003
EP 2299061 A2 3/2011
EP 3009608 A1 4/2016
WO 9517584 6/1995

* cited by examiner

STATOR ARRANGEMENT

FEDERAL RESEARCH STATEMENT

This invention was made with government support under contract number FA8650-09-D-2923-0021 from the United States Air Force Research Laboratory. The government therefore may have certain rights in this invention.

BACKGROUND

This disclosure relates to gas turbine engines, and more particularly to stator vane arrangements for gas turbine engines.

A gas turbine engine typically includes a rotor assembly which extends axially through the engine. A stator assembly is radially spaced from the rotor assembly and includes an engine case which circumscribes the rotor assembly. A flow path for working medium gasses is defined within the case and extends generally axially between the stator assembly and the rotor assembly.

The rotor assembly includes an array of rotor blades extending radially outwardly across the working medium flowpath into proximity with the case. Arrays of stator vane assemblies are alternatingly arranged between rows of rotor blades and extend inwardly from the case across the working medium flowpath into proximity with the rotor assembly to guide the working medium gases when discharged from the rotor blades. Some exit stator vane assemblies include a plurality of stator vanes extending through slotted openings in an outer shroud and likewise through slotted openings in an inner shroud. The inner shroud has a bolted connection to an inner case, while the outer shroud is loosely retained at an outer case, and thus allowed to "float" in a radial direction. The float allowed in the exit stator outer shroud is less than optimal for exit stators in controlling rotor tip clearance, and improvements in exit stator arrangements would be welcomed by the art.

SUMMARY

In one embodiment, a stator for a gas turbine engine includes a plurality of stator vanes and a shroud operably connected to the plurality of stator vanes. The shroud includes one or more shroud positioning tabs configured to engage one or more corresponding alignment features of a mating component to radially position the shroud at the mating component.

Additionally or alternatively, in this or other embodiments there is an interference fit between the one or more shroud positioning tabs and the one or more corresponding alignment features.

Additionally or alternatively, in this or other embodiments the one or more shroud positioning tabs are configured to engage the one or more corresponding alignment features to circumferentially position the shroud at the mating component.

Additionally or alternatively, in this or other embodiments the one or more shroud positioning tabs position the shroud to define a radial tip clearance between the shroud and an adjacent rotor of the gas turbine engine.

Additionally or alternatively, in this or other embodiments the shroud includes a plurality of shroud openings, a stator vane first end of the plurality of stator vanes inserted at least partially into a shroud opening of the plurality of shroud openings.

In another embodiment, a stator and case assembly for a gas turbine engine includes a case defining a working fluid flowpath for the gas turbine engine and a stator located at the case. The stator includes a plurality of stator vanes and an outer shroud located at a radially outboard extent of the plurality of stator vanes and including one or more outer shroud positioning tabs configured to engage one or more corresponding case alignment features to radially position the outer shroud at the case.

Additionally or alternatively, in this or other embodiments the one or more case alignment features include a radial positioning surface interactive with a radial tab surface of the one or more outer shroud positioning tabs to radially position the outer shroud relative to the case.

Additionally or alternatively, in this or other embodiments an interference fit exists between the radial positioning surface and the radial tab surface.

Additionally or alternatively, in this or other embodiments the one or more shroud positioning tabs are engaged with the one or more corresponding case alignment features by rotation of the outer shroud relative to the case.

Additionally or alternatively, in this or other embodiments the one or more case alignment features includes a circumferential stop.

Additionally or alternatively, in this or other embodiments the one or more outer shroud positioning tabs abuts the circumferential stop to circumferentially position the outer shroud at the case.

Additionally or alternatively, in this or other embodiments the outer shroud further includes one or more axial alignment tabs engaged with one or more axial alignment slots of the case to axially position the outer shroud relative to the case.

Additionally or alternatively, in this or other embodiments the one or more axial alignment tabs are engaged with the one or more axial alignment slots by rotation of the outer shroud relative to the case.

In yet another embodiment, a gas turbine engine includes a combustor and a stator and case assembly in in fluid communication with the combustor. The stator and case assembly includes a case defining a working fluid flowpath for the gas turbine engine and a stator located at the case. The stator includes a plurality of stator vanes and an outer shroud located at a radially outboard extent of the plurality of stator vanes and including one or more outer shroud positioning tabs configured to engage one or more corresponding case alignment features to radially position the outer shroud at the case.

Additionally or alternatively, in this or other embodiments the one or more case alignment features include a radial positioning surface interactive with a radial tab surface of the one or more outer shroud positioning tabs to radially position the outer shroud relative to the case.

Additionally or alternatively, in this or other embodiments an interference fit exists between the radial positioning surface and the radial tab surface.

Additionally or alternatively, in this or other embodiments the one or more shroud positioning tabs are engaged with the one or more corresponding case alignment features by rotation of the outer shroud relative to the case.

Additionally or alternatively, in this or other embodiments the one or more case alignment features includes a circumferential stop, the one or more outer shroud positioning tabs abuts the circumferential stop to circumferentially position the outer shroud at the case.

Additionally or alternatively, in this or other embodiments the outer shroud further includes one or more axial alignment tabs engaged with one or more axial alignment slots of the case to axially position the outer shroud relative to the case, the one or more axial alignment tabs engaged with the one or more axial alignment slots by rotation of the outer shroud relative to the case.

Additionally or alternatively, in this or other embodiments the one or more outer shroud positioning tabs position the outer shroud to define a radial tip clearance between the outer shroud and an adjacent rotor of the gas turbine engine.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
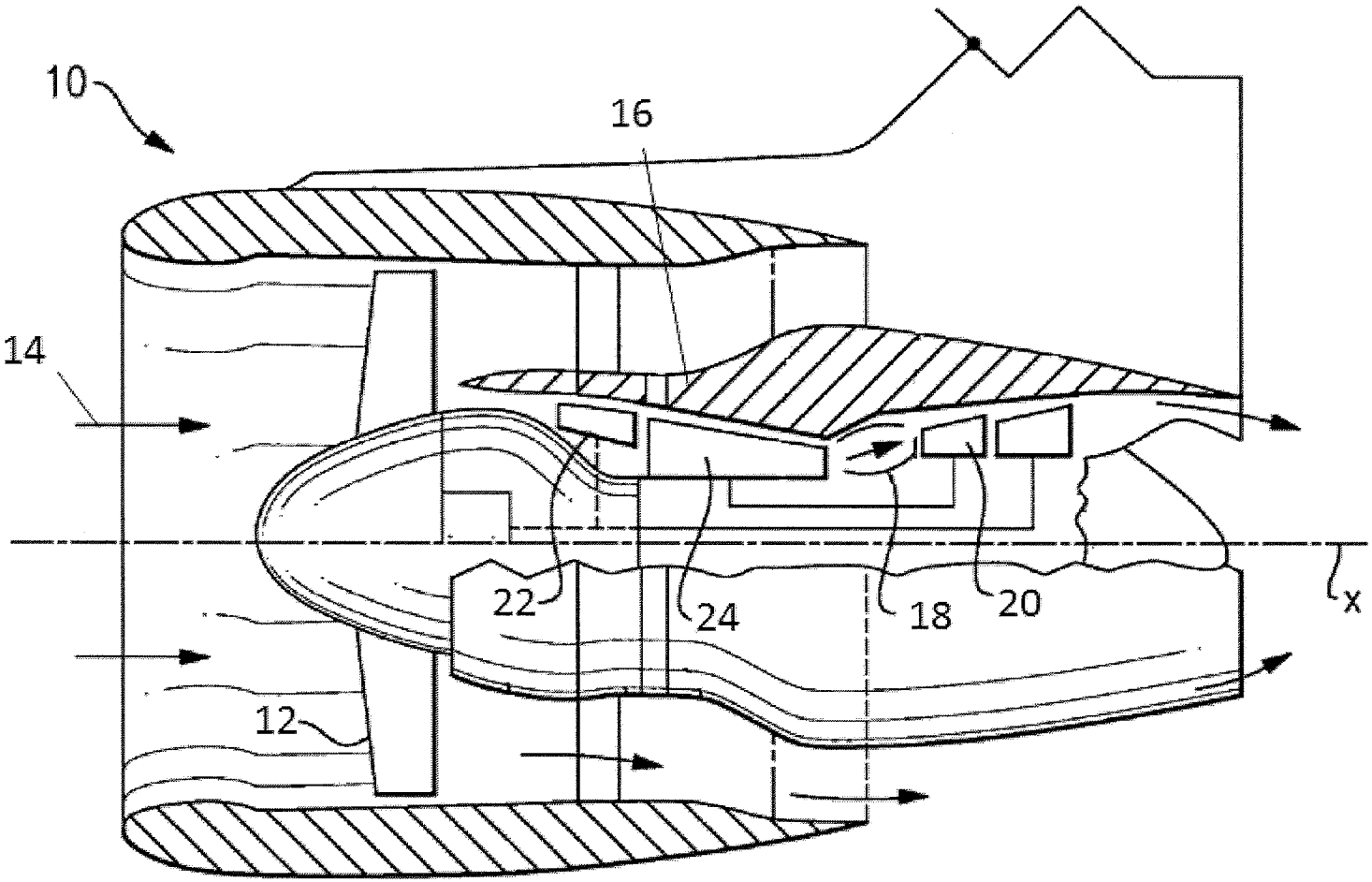
FIG. 1 is a schematic illustration of a gas turbine engine.

FIG. 1 is a schematic illustration of a gas turbine engine 10. The gas turbine engine generally has a fan 12 through which ambient air is propelled in the direction of arrow 14, a compressor 16 for pressurizing the air received from the fan 12 and a combustor 18 wherein the compressed air is mixed with fuel and ignited for generating combustion gases.

The gas turbine engine 10 further comprises a turbine section 20 for extracting energy from the combustion gases. Fuel is injected into the combustor 18 of the gas turbine engine 10 for mixing with the compressed air from the compressor 16 and ignition of the resultant mixture. The fan 12, compressor 16, combustor 18, and turbine 20 are typically all concentric about a common central longitudinal axis of the gas turbine engine 10.

The gas turbine engine 10 may further comprise a low pressure compressor 22 located upstream of a high pressure compressor 24 and a high pressure turbine located upstream of a low pressure turbine. For example, the compressor 16 may be a multi-stage compressor 16 that has a low-pressure compressor 22 and a high-pressure compressor 24 and the turbine 20 may be a multistage turbine 20 that has a high-pressure turbine and a low-pressure turbine. In one embodiment, the low-pressure compressor 22 is connected to the low-pressure turbine and the high pressure compressor 24 is connected to the high-pressure turbine.

Figure 2:
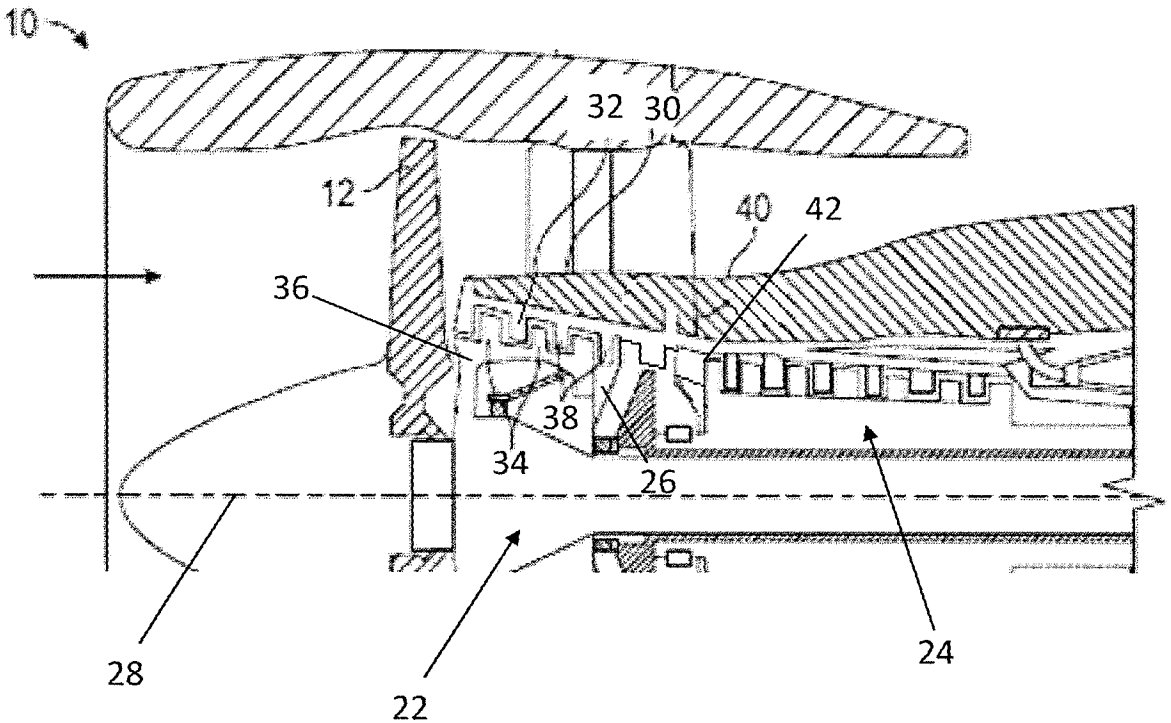
FIG. 2 is a schematic illustration of a low pressure compressor section of a gas turbine engine.

Referring now to FIG. 2, the low pressure compressor (LPC) 22 includes an LPC case 30 with one or more LPC rotors 26 located in the LPC case 30 and rotatable about an engine axis 28. One or more LPC stators 32 are located axially between successive LPC rotors 26. Each LPC rotor 26 includes a plurality of rotor blades 34 extending radially outwardly from a rotor disc 36, while each LPC stator 32 includes a plurality of stator vanes 38 extending radially inwardly from the LPC case 30. The LPC 22 further includes an intermediate case 40 located axially downstream from the LPC case 30 and is utilized to direct airflow 14 from the LPC 22 to the high pressure compressor 24. An exit stator 42 is located in the intermediate case 40.

Figure 3:
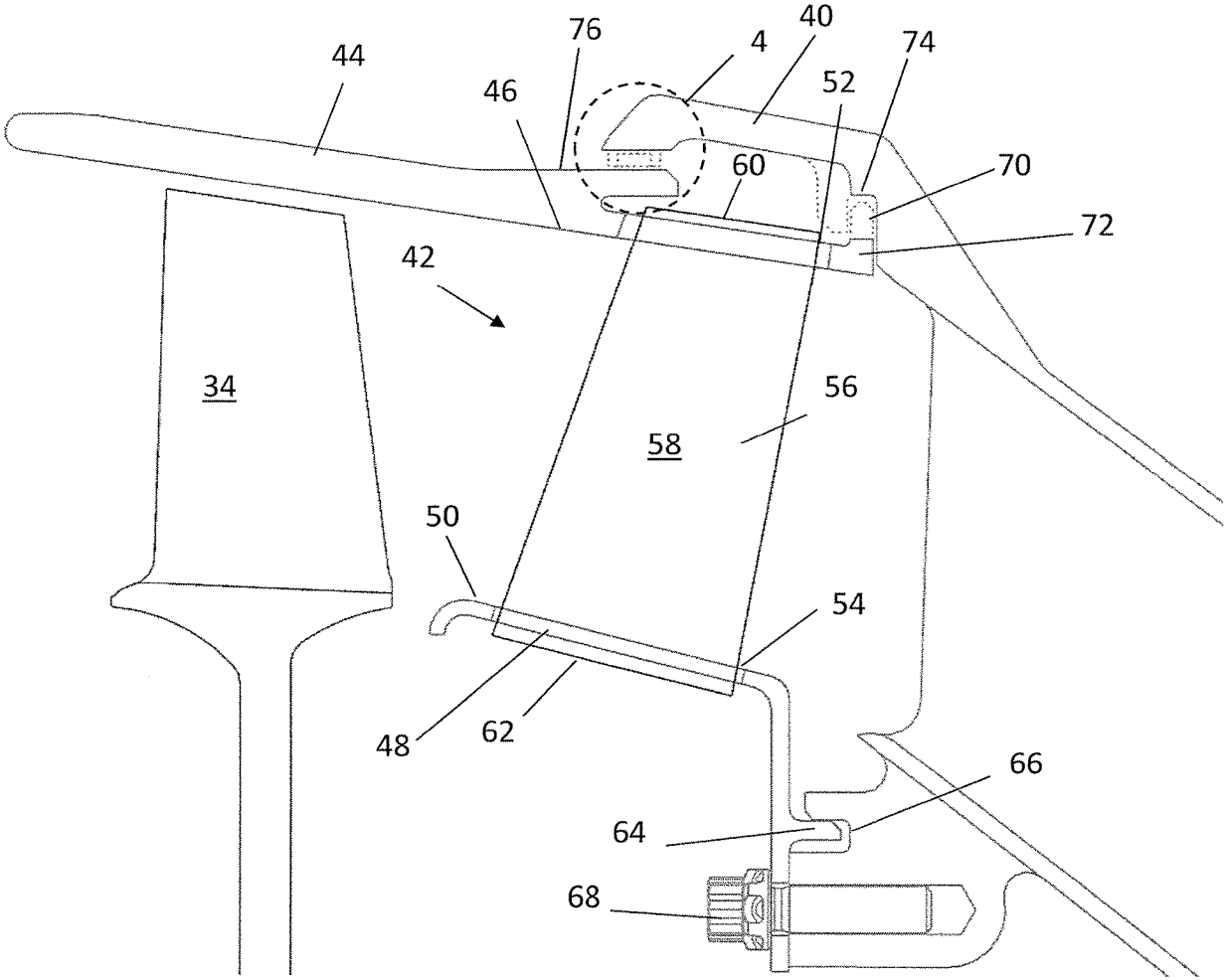
FIG. 3 is a cross-sectional view of an exit stator assembly of a low pressure compressor section of a gas turbine engine.

Referring now to FIG. 3, the exit stator 42 includes an outer shroud 44 extending circumferentially around an inner surface of the intermediate case 40 and defining an outer flowpath surface 46. The exit stator 42 similarly includes an inner shroud 48 radially spaced from the outer shroud 44 defining an inner flowpath surface 50. In some embodiments, the outer shroud 44 includes a plurality of outer shroud openings 52 spaced around a circumference of the outer shroud 44 and the inner shroud 48 includes a plurality of inner shroud openings 54 spaced around a circumference of the inner shroud 48. A plurality of exit stator vanes 56 extend from an outer shroud opening 52 to a corresponding inner shroud opening 54. Each exit stator vane 56 includes an airfoil portion 58 with an outer vane portion 60 extending into the outer shroud opening 52 and an inner vane portion 62 extending into the inner shroud opening 54. In some embodiments, as shown in FIG. 3, the outer shroud 44 extends axially over a rotor blade 34 upstream (as shown in FIG. 3) and/or downstream of the exit stator 42, defining a tip clearance between the rotor blade 34 and the outer shroud 44. Further, while the present disclosure is presented in the context of an exit stator, one skilled in the art will readily appreciate that the subject matter disclosed herein may be applied to other stators.

Figure 6:
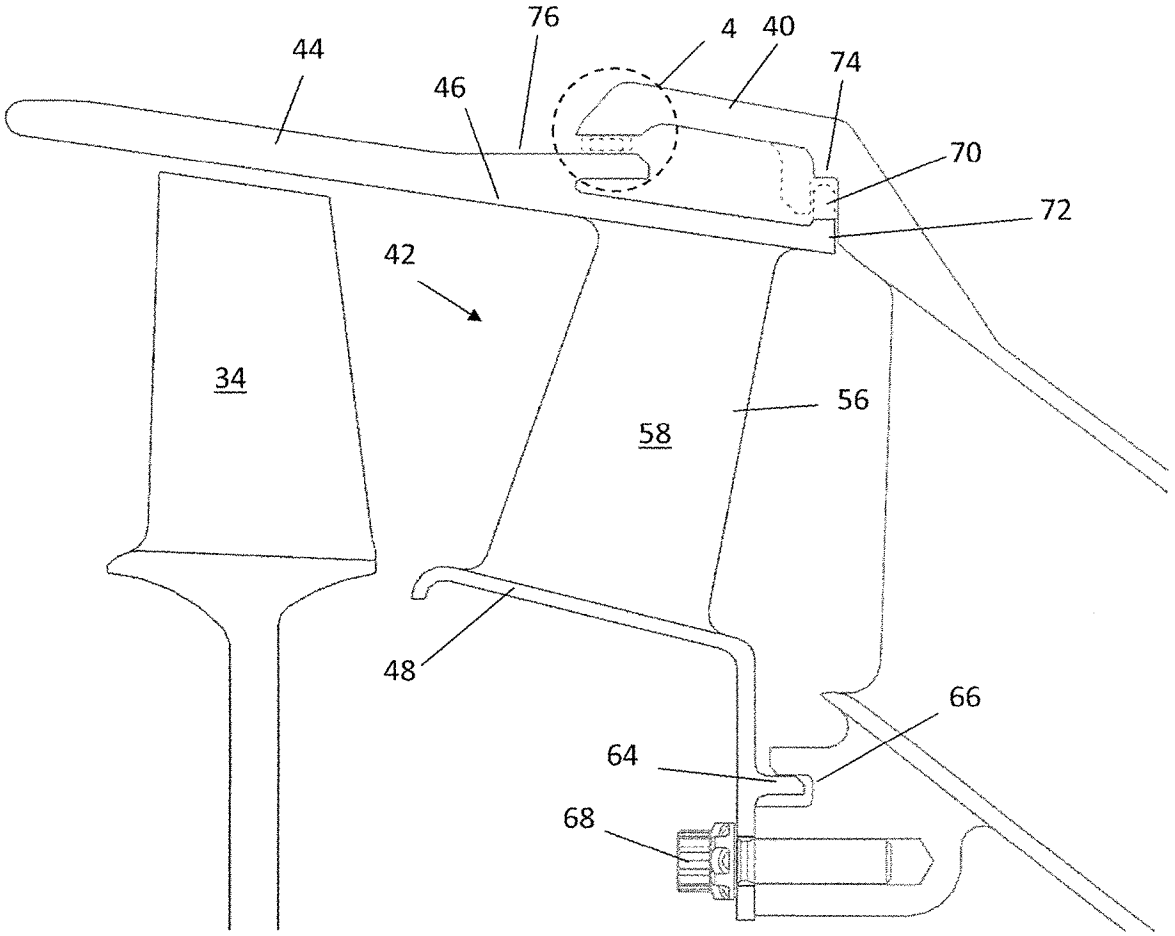
FIG. 6 is a cross-sectional view of another embodiment of an exit stator.

Referring now to FIG. 6, another embodiment of an exit stator 42 is shown. In the embodiment of FIG. 6, the exit stator 42 is formed such that the outer shroud 44, the inner shroud 48 and the stator vane 56 together are a unitary component formed by, for example, casting or other manufacturing method.

To position and retain the exit stator 42 in the intermediate case 40, the inner shroud 48 includes an axially extending inner shroud tab 64, which fits into a corresponding inner shroud slot 66 in the intermediate case 40 to loosely position the inner shroud 48 in a radial direction. Further, the inner shroud 48 is secured to the intermediate case 40 via a plurality of bolts 68. The outer shroud 44 is located in an axial direction via a plurality of radially-extending outer shroud tabs 70 located at a downstream end 72 of the outer shroud 44, which fit into a plurality of outer shroud slots 74 formed in the intermediate case 40. The outer shroud tabs 70 and the outer shroud slots 74 are circumferentially spaced around the circumference of the outer shroud 44 and the intermediate case 40, respectively, such that the outer shroud tabs 70 are engaged in the outer shroud slots 74 by circumferential rotation of the outer shroud 44 relative to the intermediate case 40.

Figure 4:
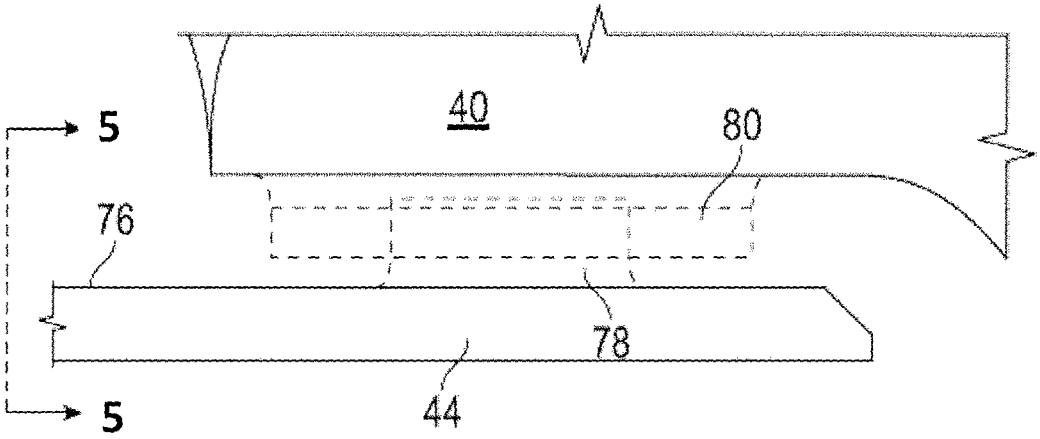
FIG. 4 is a cross-sectional view of an outer shroud retention arrangement for an exit stator.
Figure 5:
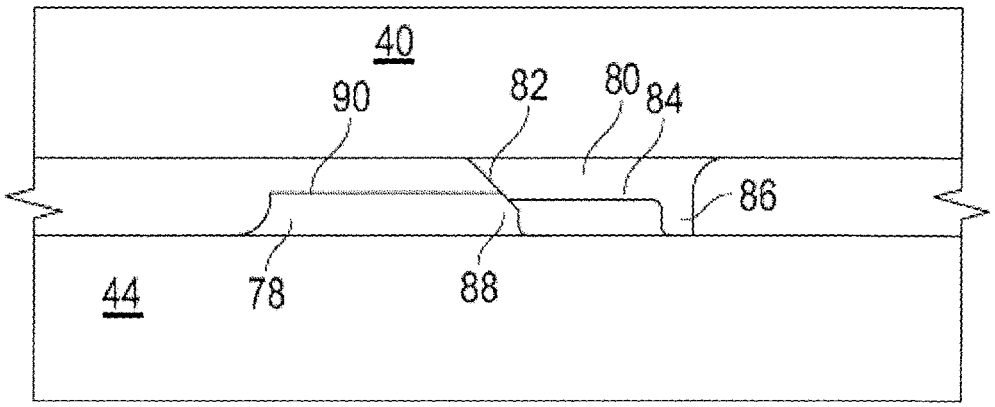
FIG. 5 is another cross-sectional view of an outer shroud retention arrangement at 4-4 of FIG. 4.

Referring to FIGS. 4 and 5, the outer shroud 44 is radially and circumferentially located via locating elements of the outer shroud 44 at an upstream end 76 of the outer shroud 44. As shown, the outer shroud 44 includes a plurality of radial positioning tabs 78 engaged with a plurality of radial pilots 80 protruding radially inwardly from the intermediate case 40. As best shown in FIG. 5, the radial pilot 80 includes a sloping pilot lead-in 82, a radial positioning surface 84 and a circumferential stop 86. The positioning tab 78 likewise includes a sloping tab lead-in 88 and a radial tab surface 90. As shown in FIG. 5, the radial tab surface 80 is at a greater radial position than the radial positioning surface 84 prior to installation.

When the outer shroud 44 is installed to the intermediate case 40, the outer shroud tabs 70 are engaged with the outer shroud slots 74 via rotation of the outer shroud 44 relative to the intermediate case 40. Similarly, the radial positioning tab 78 is engaged with the radial pilot 80 via the rotation of the outer shroud 44 relative to the intermediate case 40, resulting in an interference fit between the radial tab surface 90 and the radial positioning surface 84. This engagement between the radial tab surface 90 and the radial positioning surface 84 sets a radial position of the outer shroud 44 in the intermediate case 40. The outer shroud 44 may be rotated until the radial positioning tab 78 abuts the circumferential stop 86 thus circumferentially positioning the outer shroud 44 at the intermediate case 40.

The radial pilot 80 disclosed herein locates and retains the outer shroud 44 of the exit stator 42 in a radial direction and in a circumferential direction through engagement of the radial pilot 80 with the radial positioning tab 78 of the outer shroud 44. Location and retention of the outer shroud 44 prevents a loose fit condition of the outer shroud 44, and thus improves rotor tip clearance control of the exit stator 42. It is to be appreciated that while in the embodiments described herein the radial pilot 80 is located at the outer shroud 44, one skilled in the art will readily appreciate that in other embodiments the radial pilot may be similarly located at the inner shroud 48, or at an intermediate shroud (not shown) extending between adjacent stators 42.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. A stator for a gas turbine engine, comprising:

a plurality of stator vanes;

an outer shroud located at a radially outboard extent of the plurality of stator vanes, the outer shroud including one or more shroud positioning tabs extending radially outwardly from the outer shroud configured to engage one or more corresponding alignment features of a mating component extending radially inwardly from the mating component to radially position the shroud at the mating component;

wherein a fit between the one or more shroud positioning tabs and the one or more corresponding alignment features is a radial interference fit; wherein the one or more shroud positioning tabs position the outer shroud to define a radial tip clearance between the outer shroud and an adjacent rotor of the gas turbine engine.

2. The stator of claim 1, wherein the one or more shroud positioning tabs are configured to engage the one or more corresponding alignment features to circumferentially position the shroud at the mating component.

3. The stator of claim 1, wherein the outer shroud includes a plurality of shroud openings, a stator vane first end of each stator vane of the plurality of stator vanes inserted at least partially into a corresponding shroud opening of the plurality of shroud openings.

4. A stator and case assembly for a gas turbine engine comprising:

a case defining a working fluid flowpath for the gas turbine engine;

a stator disposed at the case, the stator including:

a plurality of stator vanes;

an outer shroud located at a radially outboard extent of the plurality of stator vanes and including one or more outer shroud positioning tabs extending radially outwardly from the outer shroud configured to engage one or more corresponding case alignment features extending radially inwardly from the case to radially position the outer shroud at the case;

wherein a fit between the one or more shroud positioning tabs and the one or more corresponding alignment features is a radial interference fit; wherein the one or more shroud positioning tabs position the outer shroud to define a radial tip clearance between the outer shroud and an adjacent rotor of the gas turbine engine.

5. The stator and case assembly of claim 4, wherein the one or more case alignment features include a radial positioning surface interactive with a radial tab surface of the one or more outer shroud positioning tabs to radially position the outer shroud relative to the case.

6. The stator and case assembly of claim 4, wherein the one or more shroud positioning tabs are engaged with the one or more corresponding case alignment features by rotation of the outer shroud relative to the case.

7. The stator and case assembly of claim 4, wherein the one or more case alignment features includes a circumferential stop.

8. The stator and case assembly of claim 7, wherein the one or more outer shroud positioning tabs abuts the circumferential stop to circumferentially position the outer shroud at the case.

9. The stator and case assembly of claim 4, wherein the outer shroud further includes one or more axial alignment tabs engaged with one or more axial alignment slots of the case to axially position the outer shroud relative to the case.

10. The stator and case assembly of claim 9, wherein the one or more axial alignment tabs are engaged with the one or more axial alignment slots by rotation of the outer shroud relative to the case.

11. A gas turbine engine, comprising:

a combustor; and a stator and case assembly in in fluid communication with the combustor, the stator and case assembly including:

a case defining a working fluid flowpath for the gas turbine engine;

a stator disposed at the case, the stator assembly including:

a plurality of stator vanes;

an outer shroud located at a radially outboard extent of the plurality of stator vanes and including one or more outer shroud positioning tabs extending radially outwardly from the outer shroud configured to engage one or more corresponding case alignment features extending radially inwardly from the case to radially position the outer shroud at the case;

wherein a fit between the one or more shroud positioning tabs and the one or more corresponding alignment features is a radial interference fit; wherein the one or more shroud positioning tabs position the outer shroud to define a radial tip clearance between the outer shroud and an adjacent rotor of the gas turbine engine.

12. The gas turbine engine of claim 11, wherein the one or more case alignment features include a radial positioning surface interactive with a radial tab surface of the one or more outer shroud positioning tabs to radially position the outer shroud relative to the case.

13. The gas turbine engine of claim 11, wherein the one or more shroud positioning tabs are engaged with the one or more corresponding case alignment features by rotation of the outer shroud relative to the case.

14. The gas turbine engine of claim 11, wherein the one or more case alignment features includes a circumferential stop, the one or more outer shroud positioning tabs abuts the circumferential stop to circumferentially position the outer shroud at the case.

15. The gas turbine engine of claim 11, wherein the outer shroud further includes one or more axial alignment tabs engaged with one or more axial alignment slots of the case to axially position the outer shroud relative to the case, the one or more axial alignment tabs engaged with the one or more axial alignment slots by rotation of the outer shroud relative to the case.

* * * * *